United States Patent [19]

Lake

[11] Patent Number: 4,971,211

[45] Date of Patent: Nov. 20, 1990

[54] DUAL CHAMBERED BABY BOTTLE

[76] Inventor: Marie I. Lake, 1216 Burford St., Huntsville, Ala. 35801

[21] Appl. No.: 421,843

[22] Filed: Oct. 16, 1989

[51] Int. Cl.[5] ..... A61J 9/00; A61J 9/08; B65D 1/04; B65D 23/10

[52] U.S. Cl. ..... 215/6; 215/100 A; 215/11.1; 215/11.6

[58] Field of Search ..... 215/6, 11.1, 11.6, 100 A, 215/11.2-11.5; D24/47, 48; D9/380

[56] References Cited

U.S. PATENT DOCUMENTS

| | | | |
|---|---|---|---|
| D. 140,467 | 2/1945 | Morse | D24/47 |
| D. 189,880 | 3/1961 | Blake | D24/47 X |
| D. 190,238 | 5/1961 | Blake | D24/47 X |
| 284,127 | 8/1983 | Gruenebaum | 215/6 X |
| D. 302,039 | 7/1989 | Downs | D24/47 |
| 825,680 | 7/1906 | Raymond | 215/6 |
| 1,589,138 | 6/1926 | Fisk | 215/11.6 |
| 2,084,689 | 6/1937 | Karl | 215/11.6 |
| 2,864,520 | 12/1958 | Pitauy | 215/11.1 |
| 2,926,805 | 3/1960 | Mead | 215/11.1 |
| 3,051,341 | 8/1962 | Mead | 215/11.1 |
| 3,269,389 | 8/1966 | Meurer et al. | 215/6 X |
| 3,467,269 | 9/1969 | Newton | 215/6 |
| 3,512,301 | 5/1970 | Kramer | 215/11.6 X |
| 4,196,808 | 4/1980 | Pardo | 215/6 X |
| 4,603,784 | 8/1986 | Chang | 215/6 X |
| 4,703,863 | 11/1987 | Kohus | 215/11.1 |
| 4,750,630 | 6/1988 | Campbell et al. | 215/100 A X |
| 4,765,514 | 8/1988 | Berglund | D9/320 X |
| 4,778,068 | 10/1988 | Kohus | 215/11.1 |
| 4,850,496 | 7/1989 | Rudell et al. | 215/11.1 X |
| 4,856,995 | 8/1989 | Wagner | 215/6 X |

FOREIGN PATENT DOCUMENTS

| | | | |
|---|---|---|---|
| 606138 | 6/1960 | Italy | 215/6 |
| 22788 | of 1911 | United Kingdom | 215/11.1 |
| 940326 | 10/1963 | United Kingdom | 215/6 |

*Primary Examiner*—Sue A. Weaver

*Attorney, Agent, or Firm*—John C. Garvin, Jr.; James E. Staudt

[57] ABSTRACT

A dual chambered baby bottle designed and constructed to selectively dispense a liquid to an infant from open end portions located at the upper end of each chamber. The chambers dispense the liquids through nipples attached to open ends of the chambers. The open ends of the chambers diverge from one another angularly and are space apart from one another so as to provide ample room for an infant to feed from one nipple without interference from the other. The nipples are provided with covers which are shaped as heads of animals for amusement of the infant and to facilitate removal thereof. The bottle is shaped to provide generally centered small diameter handles to facilitate controlled handling of the bottle by an infant. In addition to the toy-like nipple covers several figures which are attractive to infants are imprinted upon the outer surface of the bottle to make it attractive and amusing to an infant.

8 Claims, 3 Drawing Sheets

DUAL CHAMBERED BABY BOTTLE

BACKGROUND OF THE INVENTION

1. Field of the Invention

The present invention relates generally to improvements in baby bottles and, particularly to a baby bottle which dispenses liquids from a pair of individual chambers. The bottle is configured in a toy-like fashion for amusement of a baby. Additionally, the bottle is configured to permit convenient dispensing through spaced apart outlets and provides handle portions which are easily gripped by a baby.

2. Description of the Prior Art

The use of liquid containers or dispensers having more than one chamber is well known. Examples of multiple chambered baby bottles are illustrated in Chang U.S. Pat. No. 4,603,784; and in Kohus U.S. Pat. Nos. 4,703,863 and 4,778,068. Examples of multiple chambered bottles other than baby bottles are illustrated in Raymond U.S. Pat. No. 825,680; Meurer et al U.S. Pat. No. 3,269,389; Pardo U.S. Pat. No. 4,196,808; and Newton U.S. Pat No. 3,467,269. Examples of baby bottles which include decorative configurations intended to amuse a baby include Fisk U.S. Pat. No. 1,589,138; and Mead U.S. Pat. No. 2,926,805. An example of a baby bottle which is configured for ease of holding by a baby is illustrated in Campbell et al U.S. Pat. No. 4,750,630.

SUMMARY OF THE INVENTION

This invention provides a dual chambered baby-feeding bottle designed to dispense either of two liquids to an infant.

Broadly, the bottle is configured to permit a baby easy access to either chamber. The liquid is dispensed through open ends, both of which are located at one end of the bottle. The ends are spaced apart so as to provide unimpeded use of either chamber by a baby. The bottle is specifically shaped so as to be easily held by a baby and so as to accommodate several moveable as well as rigid toy-like items for the amusement of the infant.

More specifically the bottle consists of a pair of elongated chambers which are rigidly attached at one surface thereof to one another. The closed ends of the connected chambers serve as a base for standing the bottle in an upright position. The intermediate portions of the chambers extend upwardly from the closed ends and include an arcuate indentation which is so formed to provide a convenient means by which an infant can hold and control the bottle. The open end of each chamber is curved outwardly and away from the other chamber and is adapted to receive a conventional nipple assembly as well as a cover which surrounds the nipple assembly. The curved configuration of the open end of the chambers results in a spacing as well as an angular deviation between the nipples. The spacing and angular deviation features combine to provide a nursing infant with ample room to feed from one chamber without interference from the closure which covers the open end of the other chamber. This invention thus provides a baby bottle which not only provides the versatility of a dual chambered bottle but combines this versatility with the convenience of having adjacent openings, an effective handling design, and includes amusing figures and toys for the entertainment of its infant user.

DETAILED DESCRIPTION OF THE INVENTION

Figure 1:
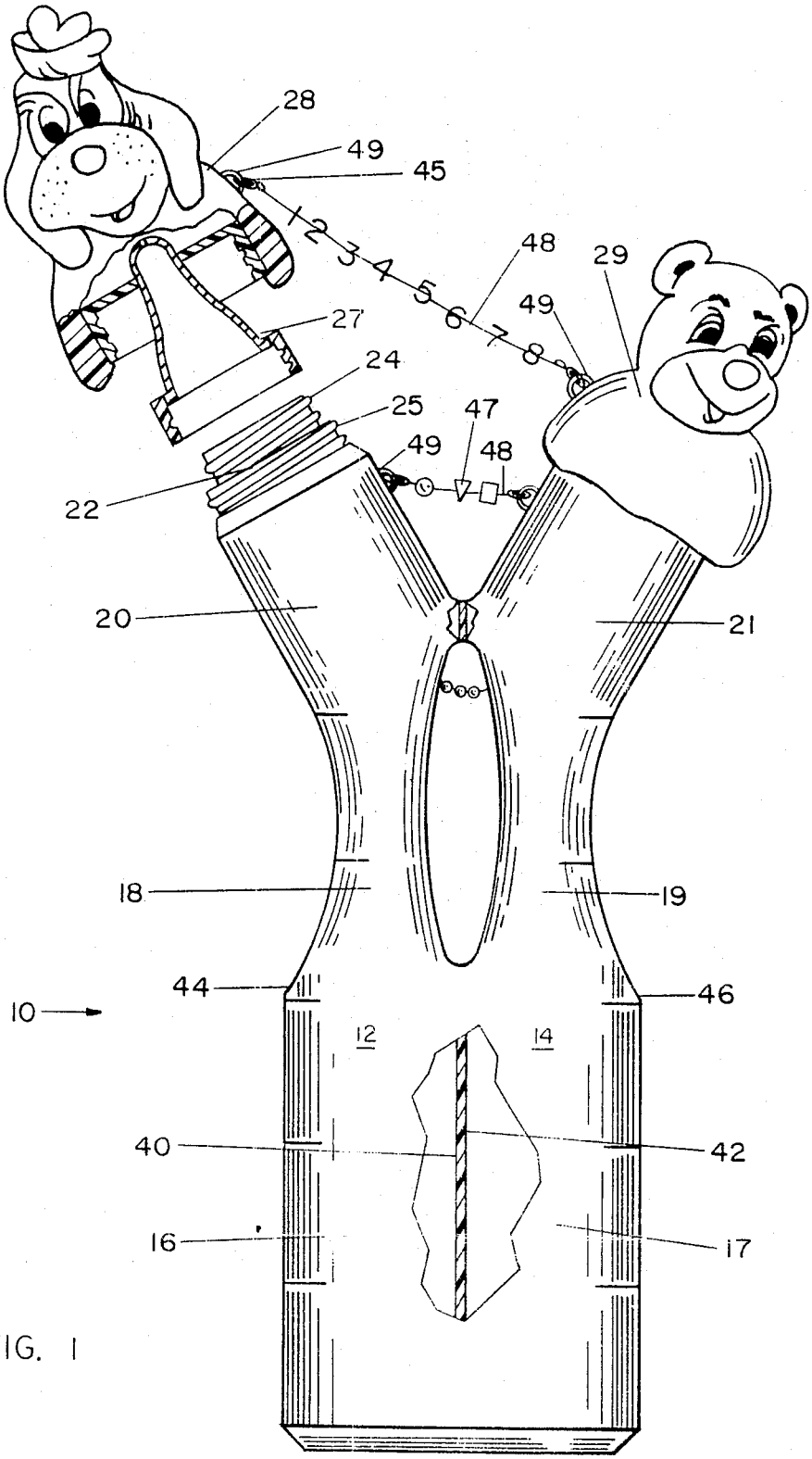
FIG. 1 is front elevational view of a baby bottle embodying the invention, and includes an exploded portion having a partial cutaway illustrating in partial section the configuration of a nipple, a nipple cover and the means for attaching the nipple and its cover to the bottle.

Referring now to FIG. 1 a baby bottle is illustrated generally by numeral 10. The bottle 10 includes a pair of chambers 12 and 14, each being a mirror image of the other. The chambers 12 and 14 include a base or closed portion 16 and 17 respectively which attach to the lower part of intermediate portions 18 and 19 respectively. Attached to the upper part of intermediate portions 18 and 19 are open portions 20 and 21. It will be noted that open portions 20 and 21 diverge angularly from one another and are provided with spaced apart terminal structures only one of which is illustrated by numeral 22 in the exploded portion of FIG. 1. This spacing and angular deviation combine to provide ample room for a baby to feed from one chamber of the bottle without interference from the closure of the other chamber. As shown in the exploded and partially fragmented portions of FIG. 1 the terminal structure 22 has threaded connector portions 24 and 25 which are adapted to threadedly engage the threaded portions of nipple assembly 27 and nipple cover 28, each of which serves as closures for chamber 12. The nipple covers 28 and 29 are configured to resemble the head of an animal for the amusement of the infant user. This configuration also serves as a handle for the infant. It will be readily understood that the configuration of the attachment structure illustrated in the exploded portion of chamber 12 will be duplicated in the terminal structure of chamber 14. The chambers 12 and 14 include radially inner surfaces 40 and 42 and radially outer walls 44 and 46. As seen in FIG. 1 the radially outer walls 44 and 46 taper inwardly from the upper area of the closed portions 16 and 17 to a narrowed portion in the area of the intermediate portions 18 and 19 and then taper gradually outwardly as they enter the open end portions 20 and 21. The radially inner surfaces 40 and 42 serve as connecting surfaces between the chambers 12 and 14. As shown further in FIG. 1, the surfaces 40 and 42 separate and taper radially outwardly in the area immediately above the closed end portions 16 and 17 and in the intermediate portions 18 and 19. The surfaces 40 and 42 then converge and reconnect in the approximate area of connection between the intermediate portions 18 and 19, and the open end portions 20 and 21. Finally the surfaces 40 and 42 diverge into the open end portions 20 and 21 so as to provide adequate spacing between the terminal structures of the end portions 20 and 21. As shown in FIG. 1 a series of movable numbers or beads 47 are attached to elastic connector lines 48 which extend between the diverging portions of open end portions 20 and 21. These connectors also serve as a means to connect the covers 28 and 29 to prevent loss while one cover is removed during use of the bottle. The elastic connectors 48 are provided with conventional snaps 45 for removable attachment to loops 49 which are formed in the open end portions 20 and 21, and in the nipple covers 28 and 29.

Figure 2:
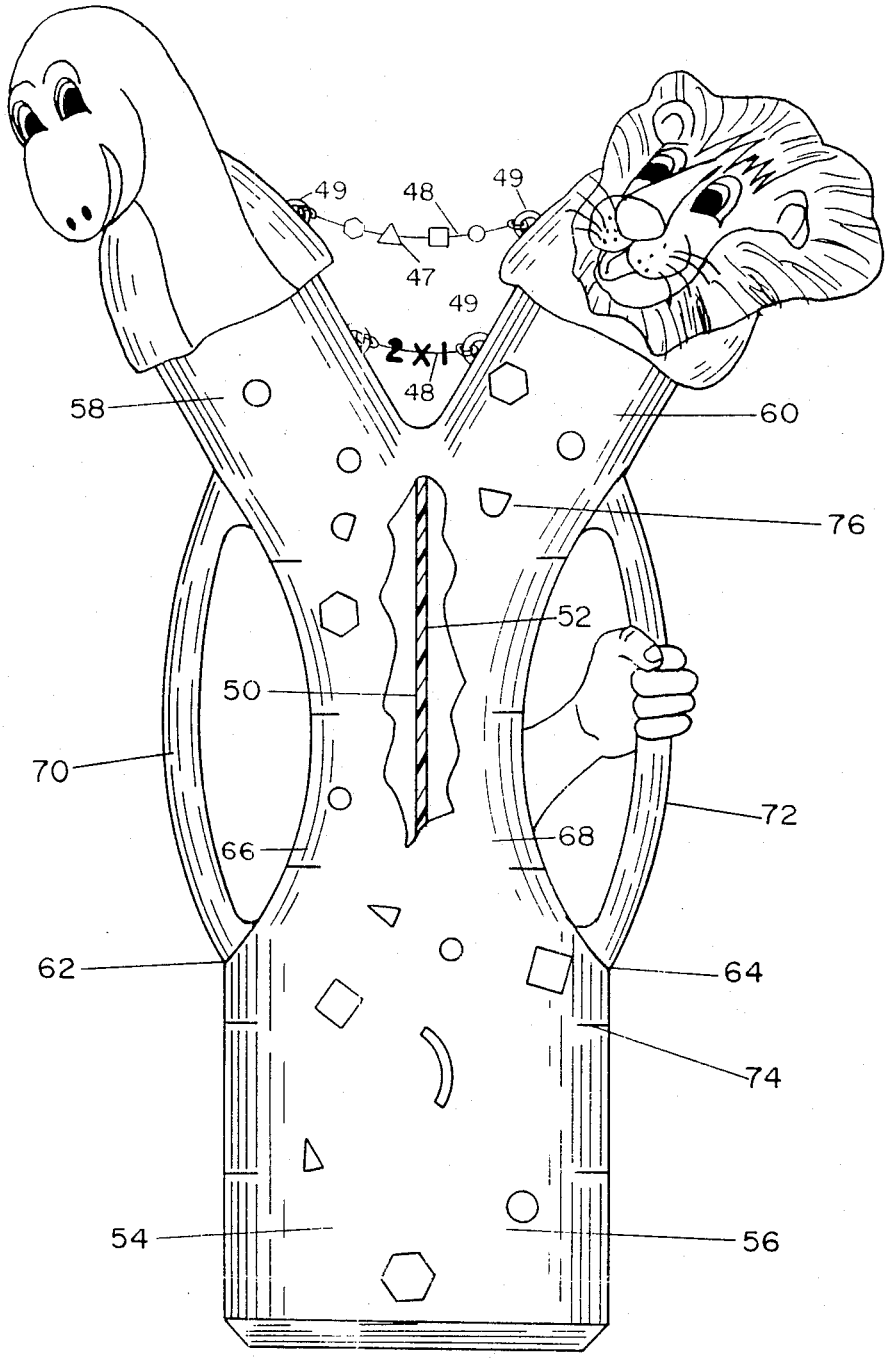
FIG. 2 is a modification of the bottle as illustrated in FIG. 1 wherein a variation of the means for holding the bottle is shown.

The modified bottle as shown in FIG. 2 is similar in basic design to that of FIG. 1 with differences in the configuration of the radially inner surfaces and the outer walls so as to provide a small diameter handle means for very small babies. As will be noted the radially inner surfaces 50 and 52 form a continuous connecting wall from the closed ends 54 and 56 to the area of open end portions 58 and 60. The radially outer surfaces 62 and 64 include arcuate radially inwardly extending portions 66 and 68, which are so formed to provide a relieved area for the accommodation of handles 70 and 72.

The bottle illustrated in FIG. 2 includes a series of measuring indicia 74 which may be numbered and spaced in accordance with the capacity of the bottle. The bottle is further provided with several FIGS. 76 of various shapes designed to amuse the infant user of the bottle. These indicia and figures of course are equally applicable for use on the bottle illustrated in FIG. 1.

Figure 3:
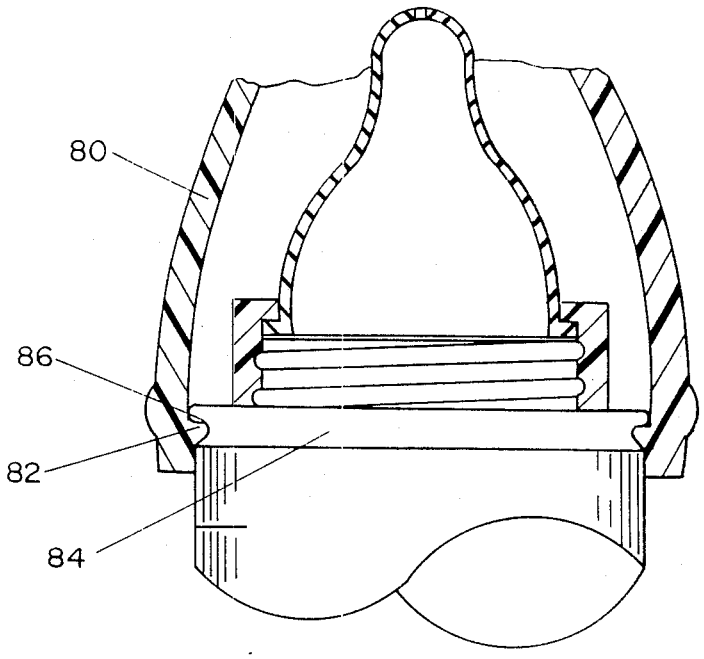
FIG. 3 is a fragmentary, vertical cross-sectional view illustrating the nipple assembly, its cover and the details of an alternate means for attachment of a nipple cover to the baby bottle.

FIG. 3 is an illustration of an alternate means of attachment for the nipple covers. As shown in FIG. 3 a nipple cover 80 which is formed of an elastic material, is provided with a radially inwardly extending protrusion 82. A terminal structure 84 is provided with a radially inwardly extending "V" shaped groove 86, which is adapted to receive protrusion 82 therein. As will be readily understood, as the elastic nipple cover 80 is pressed over the terminal structure 84 the cover will expand until the protrusion 82 and the groove 86 are aligned for mating engagement. In this way the nipple cover is retained rigidly in place and may be removed without need for rotation of the nipple cover as is required with a threaded connection.

From the foregoing it will be apparent to those skilled in the art that further modifications may be made and provided without departing from the spirit of the invention. Accordingly, the scope of the present invention is to be considered as being limited only to the extent made necessary by the claims appended hereto.

I claim:

1. A dual chambered baby bottle comprising: a left chamber and a right chamber and a right chamber; each of said chambers being a substantial mirror image of the other and having a radially inner surface and a radially outer wall, a closed end portion and an open end portion, said end portions being connected to one another by an intermediate portion, said chambers being attached to one another by said radially inner surfaces in the area adjacent said closed end portions and in the area adjacent said open end portions, said radially inner surfaces being spaced apart between said attachment areas, whereby said spacing is sufficient to utilize each of said chambers as a handle to support the baby bottle, said open end portion of each of said chambers being divergent from the open end portion of the other of said chambers so as to provide a spacing and an annular deviation therebetween: end of said open end portion having a terminal connection structure each of said terminal connection structures including a pair of connection means; a baby bottle nipple assembly attached in a dispensing position to one of said connection means; and a baby bottle nipple cover attached to the other of said connection means.

2. A baby bottle as set forth in claim 1 wherein elastic lines are attached to said open end portions of said chambers, and wherein moveable objects such as those attractive to children are positioned along said lines intermediate the points of attachment of said line.

3. A baby bottle as set forth in claim 2 wherein at least one of said nipple covers is configured as a child's toy.

4. A baby bottle as set forth in claim 1 wherein the radially outer wall of each of said chambers includes a radially inwardly curved portion adjacent the intermediate portion of each of said chambers.

5. A baby bottle as set forth in claim 4 wherein a handle is attached to each end of said inwardly curved portion of each of said chambers.

6. A baby bottle as set forth in claim 1 wherein at least one of said nipple covers is configured as a toy like figure.

7. A baby bottle as set forth in claim 6 wherein elastic lines are connected between said nipple cover attached to each of said chambers and between said open end portion of each of said chambers and wherein said lines are provided with movable beads.

8. A baby bottle as set forth in claim 7 wherein each of said chambers includes measuring indicia and includes toy like decorations on said radially outer wall.

* * * * *